US010425746B2

(12) United States Patent
Aubreville et al.

(10) Patent No.: US 10,425,746 B2
(45) Date of Patent: Sep. 24, 2019

(54) METHOD FOR OPERATING A HEARING APPARATUS, AND HEARING APPARATUS

(71) Applicant: SIVANTOS PTE. LTD., Singapore (SG)

(72) Inventors: Marc Aubreville, Nuremberg (DE); Marko Lugger, Hirschaid (DE); Homayoun Kamkar-Parsi, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/963,537

(22) Filed: Apr. 26, 2018

(65) Prior Publication Data

US 2018/0317028 A1 Nov. 1, 2018

(30) Foreign Application Priority Data

Apr. 26, 2017 (DE) ..... 10 2017 207 054
Mar. 1, 2018 (EP) ..... 18159441

(51) Int. Cl.
*H04R 25/00* (2006.01)

(52) U.S. Cl.
CPC ..... *H04R 25/505* (2013.01); *H04R 25/50* (2013.01); *H04R 25/75* (2013.01); *H04R 2225/41* (2013.01)

(58) Field of Classification Search
CPC ..... H04R 25/505; H04R 25/50; H04R 25/75; H04R 225/41
See application file for complete search history.

(56) References Cited

U.S. PATENT DOCUMENTS

| | | | | |
|---|---|---|---|---|
| 8,873,779 | B2 | 10/2014 | Lugger | |
| 8,958,587 | B2 | 2/2015 | Jensen | |
| 9,949,040 | B2 | 4/2018 | Bergmann et al. | |
| 2011/0255702 | A1 | 10/2011 | Jensen | |
| 2015/0078600 | A1* | 3/2015 | Rasmussen | H04R 25/405 381/318 |
| 2016/0105751 | A1* | 4/2016 | Zurbruegg | H04R 25/407 381/317 |

(Continued)

FOREIGN PATENT DOCUMENTS

| | | | |
|---|---|---|---|
| EP | 2381700 | A1 | 10/2011 |
| EP | 2603018 | A1 | 6/2013 |
| EP | 3101919 | A1 | 12/2016 |

*Primary Examiner* — Tuan D Nguyen
(74) *Attorney, Agent, or Firm* — Laurence A. Greenberg; Werner H. Stemer; Ralph E. Locher

(57) ABSTRACT

A hearing apparatus has a microphone for converting ambient sounds into a microphone signal, a signal processor for processing the microphone signal and an output transducer for outputting an output signal. A characteristic voice measure is ascertained for a voice component in the ambient sounds, and a supplementary measure characteristic of an activity of the wearer of the hearing apparatus is ascertained. Subsequently, an evaluated correlation between the voice measure and the supplementary measure is used to increase a probability value for the presence of a communication situation between the user and a third party if the voice measure and the supplementary measure, under at least one prescribed criterion, assume a value representative of the presence of the voice component and of the activity of the wearer. The probability value forms the basis for altering a signal processing algorithm that is executed to process the microphone signal.

19 Claims, 2 Drawing Sheets

(56) References Cited

U.S. PATENT DOCUMENTS

| | | | | |
|---|---|---|---|---|
| 2016/0360326 | A1* | 12/2016 | Bergmann | H04R 25/554 |
| 2017/0064464 | A1* | 3/2017 | Rosenkranz | H04R 25/305 |
| 2018/0020298 | A1* | 1/2018 | Courtois | H04R 25/552 |

* cited by examiner

METHOD FOR OPERATING A HEARING APPARATUS, AND HEARING APPARATUS

CROSS-REFERENCE TO RELATED APPLICATION

This application claims the priority, under 35 U.S.C. § 119, of German patent application DE 10 2017 207 054.4, filed Apr. 26, 2017, and of European patent application EP 18 159 441.7, filed Mar. 1, 2018; the prior applications are herewith incorporated by reference in their entirety.

BACKGROUND OF THE INVENTION

Field of the Invention

The invention relates to a method for operating a hearing apparatus that comprises a microphone for converting ambient sounds into a microphone signal, a signal processor for processing the microphone signal into an output signal and an output transducer for outputting the output signal to the ear of a wearer of the hearing apparatus. Moreover, the invention relates to such a hearing apparatus.

Hearing apparatuses are usually used for outputting a sound signal to the ear of the wearer of this hearing apparatus. In this case, the output is provided by means of an output transducer, for the most part acoustically by means of airborne sound using a loudspeaker (also referred to as a receiver). Frequently, such hearing apparatuses are used as what are known as hearing aids (also: hearing devices) in this case. In this regard, the hearing apparatuses normally comprise an acoustic input transducer (in particular a microphone) and a signal processor that is set up to use at least one signal processing algorithm, usually stored and/or adapted on a user-specific basis, to process the input signal (also: microphone signal) produced by the input transducer from the captured ambient sounds such that a hearing loss of the wearer of the hearing apparatus is at least partly compensated for. In particular in the case of a hearing aid, the output transducer may be not only a loudspeaker but also, alternatively, what is known as a bone conduction receiver or a cochlear implant, which are set up to mechanically or electrically couple the sound signal into the ear of the wearer. The term hearing apparatus in particular also covers devices such as e.g. What are known as tinniest maskers, headsets, headphones and the like.

Modern hearing apparatuses, in particular hearing aids, frequently comprise what is known as a classifier, which is usually configured as a part of the signal processor. For the most part, this classifier is realized by an algorithm that is used to infer a present hearing situation on the basis of the ambient sounds captured by means of the microphone, and hence to allow an alteration of the or of the respective signal processing algorithm using characteristic properties of the present hearing situation. To this end, the or the respective signal processing algorithm usually has a number of alterable parameters. The associated parameter values are then altered on the basis of a respective hearing situation. Usual hearing situations in this case are e.g. The presence of voice, the presence of music, (traveling in a) vehicle and the like. In this case, by way of example, the respective noises present (for example motor and/or wind sounds in the vehicle) are found to vary. Similarly, a clear tone for the music requires, for example, in contrast to general operation, other frequency ranges to be differently boosted (raised) and/or attenuated (lowered), for example in order to be able to better map harmonic ranges frequently required for a clear tone in the case of music.

Usually, the classifier is set up so as, when hearing situations are mixed with one another, to interpret a hearing situation detected in the "foreground" as the "primary" hearing situation and hence to skip or ignore other hearing situations present at the same time. This can disadvantageously result in misclassifications and hence in at least subjectively unfavorable settings for the signal processing algorithm. Such misclassifications of hearing situations can arise, by way of example, when music with a dominant proportion is detected in the captured ambient sounds, in contrast to voice components just with a minor proportion (here for example if the wearer of the hearing apparatus is close to a loudspeaker of a music system but a third party further away is speaking). In this case, the ambient sounds are for the most part dominated by music.

SUMMARY OF THE INVENTION

It is accordingly an object of the invention to provide a method and a hearing apparatus which overcome the above-mentioned and other disadvantages of the heretofore-known devices and methods of this general type and which improve the comfort of use of a hearing apparatus.

With the foregoing and other objects in view there is provided, in accordance with the invention, a method for operating a hearing apparatus, the hearing apparatus having a microphone for converting ambient sound into a microphone signal, a signal processor for processing the microphone signal into an output signal and an output transducer for outputting the output signal to the ear of a wearer of the hearing apparatus. The novel method comprises the following method steps:

ascertaining a characteristic voice measure for a voice component contained in the ambient sounds;

ascertaining a characteristic supplementary measure of an activity of the wearer of the hearing apparatus;

evaluating a correlation between the voice measure and the supplementary measure;

using a result of the evaluating step to increase a probability value for a presence of a communication situation between the wearer of the hearing apparatus and a third party, if the voice measure and the supplementary measure, under at least one prescribed criterion, assume a value that is representative of a presence of the voice component and of the activity of the wearer;

wherein the at least one prescribed criterion is a temporal correlation between the voice measure and the supplementary measure; and using the probability value for the presence of the communication situation as a basis for altering a signal processing algorithm that is executed to process the microphone signal.

The method according to the invention is used for operating a hearing apparatus, preferably a hearing aid. In this case, the hearing apparatus comprises a microphone for converting ambient sounds into a microphone signal, a signal processor for processing the microphone signal into an output signal and an output transducer for outputting the output signal to the ear of a wearer of the hearing apparatus.

The method involves a characteristic voice measure being ascertained for a voice component contained in the ambient sounds. Preferably, this involves ascertaining whether such a voice component is present and then in particular assigning a current value to the characteristic voice measure. Preferably, this involves using a voice activity detection module contained in the signal processor. Moreover, a characteristic supplementary measure, preferably specifically a current value therefor, is ascertained for an activity of the wearer of the hearing apparatus ("hearing device wearer"). Preferably, this also involves ascertaining whether the activity is present and then assigning the current value to the supplementary measure. Subsequently, a correlation between the voice measure and the supplementary measure is evaluated, in particular ascertained. This evaluation is used to increase a probability value—i.e. a value of a probability—for the presence of a communication situation between the hearing device wearer and a third party if the voice measure and the supplementary measure respectively under at least one prescribed criterion, (in particular respectively) assume a value representative of the presence of the voice component and of the activity of the hearing device wearer. The probability value for the presence of the communication situation is then taken as a basis for altering at least one—preferably prescribed (i.e. preferably preset at the factory or on a user-specific basis)—signal processing algorithm that is executed to process the microphone signal.

The or the respective signal processing algorithm is changed preferably by virtue of (in particular in the signal processor) at least one parameter—preferably a parameter value associated therewith—being altered, preferably set to a (different) parameter value assigned to the probability value.

The term "communication situation" is understood here and below to mean a conversation, specifically that the hearing device wearer is speaking with a third party. In other words, a communication situation is not present until at least two people, one of whom is the hearing device wearer, speak with one another.

"Increase probability value" is understood here and below to mean in particular that, in comparison with the at least one criterion not being satisfied, an increased probability of the presence of the communication situation is assumed and hence a correspondingly increased value is assigned to the probability.

Characteristic means, here and below, in particular that the voice measure and the supplementary measure respectively provide information about whether (in particular with what probability) the ambient sounds contain a voice component and the activity of the hearing device wearer is present. Optionally additionally (in particular as an alternative to the indication of the probability), the voice measure and/or the supplementary measure also respectively provide a piece of quantitative information about the voice component (for example a percentage of the whole microphone signal) and about the activity. The value representative of the presence of the voice component or of the activity is preferably formed by the applicable probability value itself and/or from a value derived therefrom, for example by means of a threshold value comparison. By way of example, a probability value (for the presence of the voice component or of the activity) is not taken into consideration as a representative value until after the threshold value is exceeded.

In an alternative variant, the voice measure and/or the supplementary measure respectively reflect a piece of qualitative information about the presence of voice components and the activity. In this case, the voice measure or the supplementary measure is in each case a kind of binary or "boolean" variable that can assume only two states. In this context, the ("first") state representative of the presence of the voice component or of the activity is set a "true" (or: "one" or an equivalent, explicit designation). Accordingly, the "second", opposite state is set as "false" (or: "zero" or the like) in this case.

The invention is based on the insight that a known classifier cannot be used to detect communication situations, i.e. actual conversations between two people, explicitly or at least explicitly with sufficient certainty. As a result of the presence of voice in general (i.e. regardless of the identity of the speaking person) and of an activity of the hearing device wearer being ascertained and a correlation between these two variables being considered and evaluated in two steps that are preferably carried out independently of one another, it is advantageously possible for the precision of the detection of a communication situation to be increased even when there are multiple superimposed hearing situations present, i.e. when not just background supplementary sounds but rather, e.g. when dominant music, traffic noise or the like is present. Advantageously, this may possibly also reduce a need for the hearing device wearer to himself actively make a change to the settings of his hearing apparatus (for example on account of a misclassification). This in turn advantageously increases the comfort of use of the respective hearing apparatus.

In a preferred method variant, the or the respective signal processing algorithm is altered continually on the basis of the probability value for the presence of the communication situation. This is also referred to as "dynamically" starting up a hearing device setting. By way of example, the respective parameter value of the or of the respective signal processing algorithm is altered gradually or continuously in this case—i.e. if the probability value is comparatively low, for example, a correspondingly slight alteration also takes place. In particular, the or the respective parameter value is mapped by a function of the probability value for the presence of the communication situation. This can advantageously allow a particularly smooth transition, in particular one that is barely noticeable or at least subjectively pleasant for the hearing device wearer, between different settings—i.e. differently oriented signal processing—of the hearing apparatus. Artefacts during an alteration of the settings can advantageously be decreased in this case.

In one method variant, the supplementary measure used for the activity of the hearing device wearer is in particular a measure of the orientation of the head of the hearing device wearer, in particular of a head movement. By way of example, this measure is ascertained by means of a position sensor, in particular by means of an acceleration sensor (preferably comprised by the hearing apparatus) and/or a gyroscopic sensor (in particular a rotation sensor). During the evaluation of the correlation, the supplementary measure is used, by way of example, to ascertain whether the hearing device wearer turns his head toward a source of the voice component, in particular in order to speak with, at least to listen to, the person who is this source.

In a particularly preferred method variant, the supplementary measure ascertained for the activity of the hearing device wearer is an own voice measure, preferably specifically a current value therefor, characteristic of the presence of the own voice of the hearing device wearer. In particular, this involves ascertaining whether his own voice is present (i.e. whether the hearing device wearer himself is speaking) and subsequently assigning the current value to the own voice measure. Preferably, this is done by using an own voice detection module, in particular that the signal processor comprises. Accordingly, the probability value for the presence of the communication situation is preferably then determined by virtue of the correlation between the voice measure and the own voice measure being evaluated. That is to say that preferably the voice measure and the own voice measure are related to one another. As a result of it being ascertained, independently of one another, whether voice is present and whether the hearing device wearer himself is speaking and a correlation between the voice and own voice being considered and evaluated, it is advantageously possible for the precision of the detection of a communication situation to be increased even when multiple superimposed hearing situations are present. The presence of the hearing device wearer's own voice provides a comparatively strong indication in this case that the hearing device wearer is participating in a conversation.

The prescribed criterion used, i.e. considered or analyzed, for the presence of the communication situation is a temporal correlation between the voice measure and the supplementary measure, in particular the own voice measure. By way of example, this involves ascertaining whether the head movement occurs immediately before or after (i.e. within a few seconds, for example 1 to 3 seconds) the voice measure assumes the representative value. From this, it is in particular possible to infer that the hearing device wearer looks at his interlocutor before he himself addresses him and/or after the interlocutor has addressed the hearing device wearer.

In a preferred method variant, the probability value for the presence of the communication situation is increased if a temporal difference between the voice measure and in particular the own voice measure, preferably specifically between the respective value representative of the presence of voice or own voice is ascertained. That is to say that it is ascertained whether the respective representative values are present for different lengths of time. This is based on the insight that in a conversation the own voice of the hearing device wearer and voice of a third party (i.e. of the interlocutor) are usually not exclusively present at the same time.

In a preferred development of the method variant above, the probability value for the presence of the communication situation is increased in particular if within a prescribed period the voice measure and the own voice measure assume the value representative of the presence of the voice component or of the own voice for a respective different length of time. In this case, it is therefore in particular checked whether the voice measure and the own voice measure respectively indicate the actual presence of the voice of a third party and of the own voice of the hearing device wearer in a manner characteristic of a conversation between two people. By way of example, detection of the voice component (or of the value representative thereof) involves the prescribed period started being a time window within which a check is performed to determine whether the own voice measure indicates the presence of the hearing device wearer's own voice for a shorter time (i.e. length of time) than the voice measure indicates the presence of a voice component. The prescribed criterion used in this development is thus in particular that the voice measure and the own voice measure indicate the actual presence of the voice of a third party and of the own voice within the prescribed period.

The method variant described above is expedient in particular in that the voice activity detection module cited above is used to detect the presence of any voice in the ambient sounds, i.e. including the presence of the own voice of the hearing device wearer. The own voice measure (which is preferably ascertained by means of the own voice detection module described above), by contrast, indicates exclusively the presence of the own voice of the hearing device wearer. Consequently, the presence of the voice of a third party (i.e. The fact that a third party is speaking) is expediently inferred if in one phase (i.e. in particular within a portion of the period described above) exclusively the voice measure assumes the value representative of the voice component. If, by contrast, the voice measure and the own voice measure have the respective value representative of the presence of the associated voice at the same time, it is in particular inferred that the hearing device wearer is actually speaking himself. Expediently, this method variant thus involves the phases in which the hearing device wearer and a third party respectively speak being ascertained. Optionally, as a development of this method variant, the criterion ascertained for increasing the probability value for the presence of the communication situation is a non-equivalence (or a value therefor) between the own voice of the hearing device wearer and the voice of a third party. That is to say that in particular the probability value for the presence of the communication situation is increased if either a third party or the hearing device wearer speaks, but preferably also both speak within the prescribed period.

The prescribed period used is preferably at least several seconds, for example 3 to 5 or up to 30, in particular approximately 20 seconds. The shorter the period, the more quickly the or the respective signal processing algorithm can be altered, so that the hearing device wearer needs to wait for adaptation of the signal processing to suit the altered hearing situation only for short reaction times. On the other hand, a certain length of time is also required, however, in order to be able to assume a certain probability of the presence of the communication situation, in particular detect a conversation between the hearing device wearer and a third person and in particular to distinguish it from a "mere" exchange of greetings between two people, with sufficient certainty.

In an expedient method variant, the presence, or the detection of the communication situation, in particular by the signal processor, is precluded—preferably by virtue of the probability value not being increased or set to a value close to "zero" or at "zero"—if only (i.e. exclusively) the voice measure assumes the value representative of the presence of the voice component. This advantageously makes it possible to prevent the signal processing algorithm from being altered if there is voice on TV or on the radio, for example. In an optional development of this method variant, the presence of the communication situation is in particular also precluded if, by way of example, the own voice measure assumes the value representative of the presence of the own voice of the hearing device wearer only for negligibly short lengths of time, for example for 1 second or less, whereas the voice measure has the value representative of the presence of the voice component in particular throughout or for a length of time that is longer by a multiple—for example at least ten times. This kind of temporal distribution for the respective representative values of the voice measure and the own voice measure is also referred to as "highly asymmetric" in this context.

In a further expedient method variant, the presence of the communication situation is precluded if the voice measure and the own voice measure in particular always substantially (i.e. exactly or with only minor disparities) concurrently (i.e. preferably at the same time and for the same length of time in each case) assume the value representative of the presence of the voice component and the own voice of the hearing device wearer. The reason is that in this case it is possible that a soliloquy, the hearing device wearer "singing along" to a piece of music being played and the like may be involved, for example. In this case, however, there is usually no communication situation present, i.e. no conversation between the hearing device wearer and a third party.

In an advantageous method variant, within the prescribed period described above phases of preferably prescribed length (for example from 1 to no more than 5 seconds) in which the voice measure does not assume a value representative of the presence of the voice component are ignored. Such an approach advantageously allows pauses in voice, which usually occur in every conversation, to be skipped without the probability value being mistakenly decreased or the monitoring of the prescribed period being terminated. As a result of the voice measure also indicating the presence of own voice, such a pause in voice can, if the whole hearing apparatus is functioning properly as normal, therefore occur only if there is no voice at all—i.e. The own voice measure also does not assume the representative value.

In a further expedient method variant, the (optionally further) prescribed criterion used is that within the prescribed period the hearing device wearer preferably speaks at least twice (in particular with in each case an intervening pause in which a third party speaks). In this case, the probability value for the presence of the communication situation is thus increased if the own voice measure repeatedly assumes the value representative of the presence of the own voice within the prescribed period. Additionally or alternatively, the probability value is increased if within the prescribed period described above a third party speaks at least twice—preferably with in each case an intervening pause in which the hearing device wearer speaks. The (optionally additional) prescribed criterion used within the context of this method variant is thus that within the prescribed period the voice measure and/or the own voice measure repeatedly, i.e. at least twice, assume the value representative of the presence of the voice component and of the own voice of the wearer. In particular, this method variant involves checking during the aforementioned period whether an (in particular alternate) "voice sequence" (also referred to as "alternation") at least in the style "hearing device wearer—third party—hearing device wearer" or "third party—hearing device wearer—third party" takes place. As a result, it is, by way of example, advantageously possible to prevent a single shout with a single response, for example including a greeting with a subsequent reply, from resulting in the probability value for the communication situation being increased.

In an expedient development, in particular of the method variant described above, the (optionally additional) criterion used for increasing the probability value for the presence of the communication situation is that the hearing device wearer and/or the third party speak more than twice.

In one optional method variant, the (in particular further) criterion used is that within the period described above the respective temporal components for which it is ascertained (or a particularly high probability is assumed) that the hearing device wearer and the third party are speaking are roughly (i.e. preferably with disparities of between 10 and 30%) equivalent. That is to say that the probability value for the presence of the communication situation is increased (in particular further) if the ratio between the voice of the hearing device wearer and of the third party is approximately level. In particular, the additional criterion specifically ascertained in this case is whether the length of time (possibly the sum of the individual lengths of time detected within the period, i.e. The total time) for which the voice measure assumes the value representative of the presence of the voice component approaches (i.e. within the aforementioned range) twice the length of time (or the sum or total time thereof) for which the own voice measure assumes the associated representative value.

In a further optional method variant, preferably multiple criteria (in particular those described here and below) are preferably used to increase the probability value for the presence of the communication situation. In particular, the probability value is increased in this case on the basis of multiple satisfied or in particular also only partly satisfied (e.g. when repeated alternation is required after just a single change) criteria—in the case of only partly satisfied criteria, preferably by an accordingly smaller prescribed step size. By way of example, the probability value can, when just a smaller number of criteria than the prescribed number is satisfied, be set at such a level that a limit value optionally prescribed for an alteration is exceeded and then an alteration (preferably associated with the current probability value, and in particular accordingly smaller) to the signal processing algorithm is performed. By way of example, in this case the probability value for the presence of the communication situation is already increased when a repeated alternation has been detected after only 10 seconds within the prescribed period of, for example, 20 seconds such that the signal processing algorithm is altered. In other words, cumulative satisfaction of multiple criteria results in a cumulative or optionally also progressive increase in the probability value. In the latter case, as the number of satisfied criteria increases, the probability value for each further satisfied criterion is thus increased using a larger step than when this criterion is satisfied on its own. By taking into consideration that multiple criteria are (possibly even only partly) satisfied, faster, i.e. especially early, alteration of the or of the respective signal processing algorithm is advantageously made possible.

In an expedient embodiment, the hearing apparatus comprises a classifier for detecting different (in particular additional, different than the communication situation) hearing situations, preferably for allocating probability values for the presence of the respective hearing situation. In this case, in a preferred method variant, in particular when a prescribed threshold value for the probability value for the presence of the communication situation is exceeded, the or the respective signal processing algorithm is altered with a higher priority for the communication situation in comparison with other hearing situations detected in parallel. This advantageously allows, in particular in ambiguous hearing situations (i.e. when multiple hearing situations are present at the same time), the conversation that is likewise present from the hearing device wearer to be prioritized and the signal processing therefore always to be oriented (if need be primarily) to the communication situation. In particular, this means that it is also possible for conversations between the hearing device wearer and third parties that have dominant music, traffic noise or the like superimposed on them, for example, to be detected as such particularly reliably and to result in alteration of the signal processing algorithm. As an alternative or optionally in addition to the aforementioned threshold value comparison, the alteration of the or the respective signal processing algorithm, in particular of the respective parameter, on the basis of the probability value for the communication situation is weighted more heavily, at least in the case of ambiguous hearing situations, than on the basis of probability values for other hearing situations. That is to say that a change on the basis of the communication situation preferably ends up being more severe than a change on the basis of other hearing situations. This method variant is in particular based on the consideration that even in the case of superimposed hearing situations the hearing device wearer has a high probability of wanting to devote his attention to a conversation if he himself participates therein.

In a preferred development of the method variant described above, in the case of ambiguous hearing situations the or the respective signal processing algorithm is also altered on the basis of multiple detected hearing situations (or at least on the basis of a respective prescribed probability of the respective presence of these hearing situations). Thus, by way of example, a parameter directed at a clear tone of music and a parameter directed at voice intelligibility are altered if, both for music and for the communication situation, probability values representative of the respective presence are ascertained. Preferably, however, in this case—as described above—the parameter directed at voice intelligibility is altered more severely than the one directed at the clear tone of music.

In an expedient method variant, "speaking" by the hearing device wearer and/or the third party is interpreted as an "utterance" by the respective person that belongs to a conversation—i.e. to the voice sequence described above—(in particular only) if it is detected that the hearing device wearer or the third party speaks for at least 1 or 2 seconds, i.e. The respective representative value of the voice measure or of the own voice measure needs to be present throughout for this length of time. In particular, the (preferably further prescribed) criterion used in this case is therefore that the respective utterance by the third party and/or the hearing device wearer lasts for at least 1 or 2 seconds.

In a further expedient method variant, the (in particular additional) criterion used is that within a past period of time (in particular one preceding the prescribed period) of prescribed length the probability value for the presence of the communication situation has already had a prescribed value once. In particular, the aim here is thus to ascertain whether the or the respective signal processing algorithm has already been adapted to suit the communication situation in the past two to five (optionally also up to ten) minutes. In particular if (when there are multiple criteria to be satisfied) some of the prescribed criteria have simultaneously also already been satisfied or satisfied only in part (for example if only part of the prescribed voice sequence is present, e.g. only a "hearing device wearer—third party" exchange or vice versa), the probability value for the presence of the communication situation can actually be increased (or optionally the prescribed period can be shorted from 20 seconds to 10 seconds, for example) at an earlier time or by a larger step size in this case. The reason is that in this case it is assumed that the probability of the previous conversation being resumed or the hearing device wearer starting a new one—for example at an event—is increased. Optionally, this method variant also takes into consideration the length of time for which the communication situation was present in the past period of time. By way of example, the invention may have provision in this case for a preceding conversation of, by way of example, at least three minutes (i.e. a communication situation lasting for such a length of time) to involve the prescribed period being shortened as appropriate and/or just a single exchange of voice (instead of a multiple exchange) between the third party and the hearing device wearer being sufficient to detect the communication situation.

In an expedient method variant, the communication situation is detected by virtue of a wearer-specific inclination toward participation in conversations, i.e. whether the hearing device wearer enjoys speaking with third parties a lot, being taken into consideration. In this case, this is taken into consideration preferably by means of appropriate adaptation of at least some of the criteria described above. By way of example, the period described above within which the alternation needs to be detected—in particular when the hearing apparatus is first adapted—is set to a shorter length of time (for example 8 or 10 seconds instead of 20 seconds) in comparison with an average hearing device wearer when there is a strong inclination toward participation in conversation. Optionally additionally or alternatively, just a single alternation, i.e. a single exchange between the own voice and the voice of a third party, within the prescribed period can also be used to detect the communication situation. Therefore, it is advantageously possible to allow a "more aggressive", i.e. faster or "steeper" ("in larger steps"), increase in the probability value for the presence of the communication situation, and hence particularly early alteration of the or of the respective signal processing algorithm.

In a further expedient method variant, the (in particular additional) criterion used is that a streaming signal of a communication device (for example a mobile phone or the like) is received. Such a streaming signal is usually present in particular when the hearing device wearer also actually wishes to communicate.

In a further expedient method variant, which is also an independent invention, a memory unit of the hearing apparatus is used, preferably on a daily basis (for example on the basis of a clock integrated in the hearing apparatus, specifically in the signal processor), to store a frequency index for the detection of the communication situation, i.e. in particular for the alteration of the or of the respective signal processing algorithm, on the basis of the probability value for the presence of the communication situation. In other words, the hearing apparatus records how often, in particular in a day, the hearing device wearer communicates, i.e. participates in conversations. This frequency index, in particular the trend therein over the duration of a therapy by means of the hearing apparatus, can provide information regarding how well the therapy of the hearing device wearer "works". The better the hearing device wearer is supplied with communication-relevant sound signals, the more the hearing device wearer would also have a high probability (in particular again in future) of participating in conversations, in particular of becoming reaccustomed to participating in conversations.

In yet a further expedient method variant, during a reproduction of an external audio signal, the output signal is produced by virtue of a mix ratio between the microphone signal and the audio signal being altered on the basis of the probability value for the presence of the communication situation. Usually, in a "listening situation", i.e. while the audio signal is received from an external source (in particular a media device such as e.g. a TV set, a music system, a reading audio system or the like) as an (in particular non-acoustic) data signal, the microphone signal is suppressed or at least severely attenuated during production of the output signal, since it is regularly assumed that the priority of the hearing device wearer in such a situation lies with the external audio signal. The alteration of the mix ratio—in particular by mixing the microphone signal with the audio signal in the output signal—on the basis of the probability value for the presence of the communication situation advantageously allows a reaction and adaptation of the signal processing that are independent of a user input.

Preferably, in the method variant above, in particular when the probability value for the presence of the communication situation has been increased, the output signal is produced by virtue of the proportion of the microphone signal being increased in comparison with the external audio signal (in particular in comparison with the standard mix in the listening situation). Optionally, the external audio signal is also withdrawn in this case at the same time, i.e. it is attenuated or not boosted during production of the output signal. This advantageously automatically, and in particular independently of a user input, also widens the attention of the hearing device wearer to the present conversation, specifically increases (voice) intelligibility for the opposite party. This in particular also allows particularly robust autonomous "changeover" (adaptation of the signal processing) from the listening situation to the communication situation to be made possible.

In an advantageous method variant, when the probability value for the presence of the communication situation—i.e. preferably if the prerequisites for the presence of the communication situation are no longer present—is decreased, in particular after additional expiry of a prescribed waiting time, the alteration of the or of the respective signal processing algorithm, in particular the altered mix ratio between the microphone signal and the audio signal, is reset. In other words, in this case the signal processing is preferably "reversed" again to the preceding setting, in particular provided that the classifier described above does not detect a different new hearing situation. In the case described above for the listening situation present before detection of the communication situation and attuned to the external audio signal, the external audio signal is thus prioritized (again) if the communication situation is no longer present.

With the above and other objects in view there is also provided, in accordance with the invention, a hearing apparatus which comprises, as described above, the microphone for converting the ambient sounds into the microphone signal, the signal processor for processing the microphone signal into the output signal and the output transducer that outputs the output signal to the ear of the hearing device wearer. In this case, the signal processor of the hearing apparatus is set up, according to the invention, to perform the method described above. In other words, the signal processor is set up to ascertain the characteristic voice measure, specifically the current value thereof, for the voice component contained in the ambient sounds, and also the supplementary measure characteristic of the activity of the hearing device wearer, in particular the own voice measure, specifically the current value thereof, characteristic of the presence of the own voice of the hearing device wearer. Moreover, the signal processor is set up to evaluate a correlation between the voice measure and the supplementary measure or the own voice measure and to use this evaluation to increase the probability value for the presence of the communication situation if the voice measure and the supplementary measure or own voice measure, and at least one of the criteria described above, assumes the respective value representative of the presence of the voice component and the activity (in particular the own voice). Moreover, the signal processor is set up, according to the invention, to take the probability value for the presence of the communication situation as a basis for altering the or the respective signal processing algorithm.

In this case, the hearing apparatus according to the invention has the same advantages as are described in connection with the method described above.

In a preferred configuration, the signal processor is formed, at least in essence, by a microcontroller having a processor and a data memory in which the functionality for performing the method according to the invention is implemented in the form of a piece of operating software (firmware) by means of programming, so that the method—if need be in interaction with the hearing device wearer—is performed automatically when the operating software is executed in the microcontroller. Alternatively, the signal processor is formed by a non-programmable electronic component, e.g. an ASIC, in which the functionality for performing the method according to the invention is implemented using circuitry means.

In a preferred embodiment, the hearing apparatus comprises the voice activity detection module (also referred to as a "voice activity detector") described above, which is preferably configured as part of the signal processor. In a likewise preferred embodiment, the hearing apparatus furthermore also comprises the own voice detection module (also referred to as an "own voice detector") described above, which is preferably likewise configured as part of the signal processor.

In an expedient embodiment, the hearing apparatus comprises an input interface that is set up for receiving the external audio signal described above. By way of example, the input interface is an antenna, a jack plug, a male connection for a data cable or the like.

The conjunction "and/or" is intended to be understood here and below such that the features combined by means of this conjunction may be configured either together or as alternatives to one another.

Other features which are considered as characteristic for the invention are set forth in the appended claims.

Although the invention is illustrated and described herein as embodied in a method for operating a hearing apparatus and a novel hearing apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Parts and variables that correspond to one another are provided with the same reference symbols throughout the figures.

DETAILED DESCRIPTION OF THE INVENTION

Figure 1:
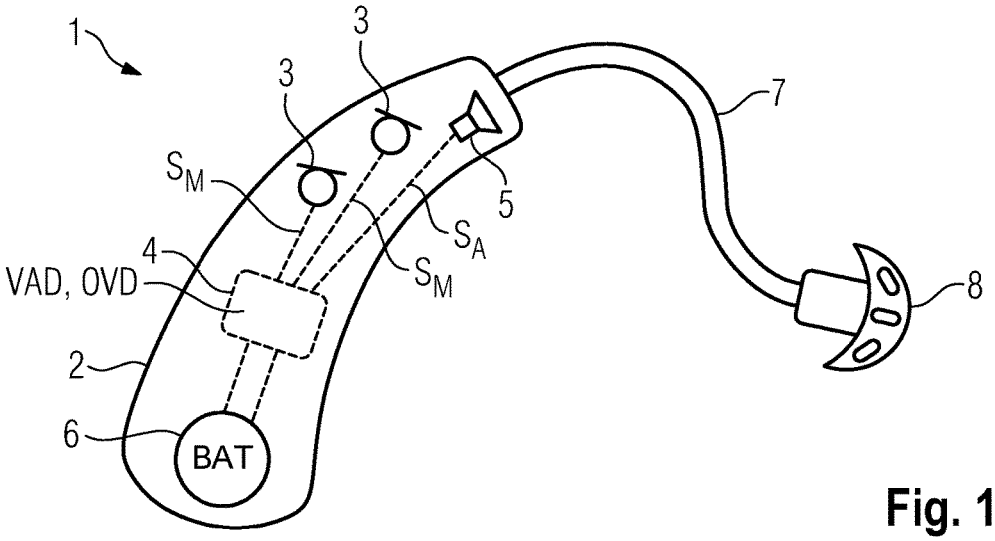
FIG. 1 shows a schematic circuit overview for a hearing device.

Referring now to the figures of the drawing in detail and first, particularly, to FIG. 1 thereof, there is shown a hearing aid ("hearing device 1") forming a hearing apparatus. The hearing device 1 comprises several electrical components in a housing 2, namely, two microphones 3, a signal processor 4 and a loudspeaker 5. To supply power to the electrical components, the hearing device 1 moreover comprises a battery 6, which may alternatively be configured as a primary cell (for example as a button cell) or as a secondary cell (i.e. as a rechargeable battery). The microphones 3 are used to capture ambient sounds during operation of the hearing device 1 and to produce a respective microphone signal SM from said ambient sounds. These two microphone signals SM are supplied to the signal processor 4, which executes a signal processing algorithm to generate an output signal SA from these microphone signals SM and outputs said output signal to the loudspeaker 5. In this case, the loudspeaker 5 is an output transducer and converts the output signal SA into airborne sound, which is output to the ear of a wearer (hearing device wearer) of the hearing device 1 via a sound tube 7 adjoining the housing 2 and an earpiece 8 connected to the end of said tube. The signal processor 4 additionally also comprises a classifier by means of which different hearing situations (e.g. voice, music, vehicle and the like) are inferred on the basis of the ambient sounds that the microphone signals SM contain. Depending on the detected hearing situation, at least one specifically associated parameter of the signal processing algorithm is altered. As a result, the signal processing of the hearing device 1 can be adapted to suit different hearing situations and the sound output of the loudspeaker 5 can be improved in respect of the spectral properties of the ambient sounds denoting the respective hearing situation.

Figure 2:
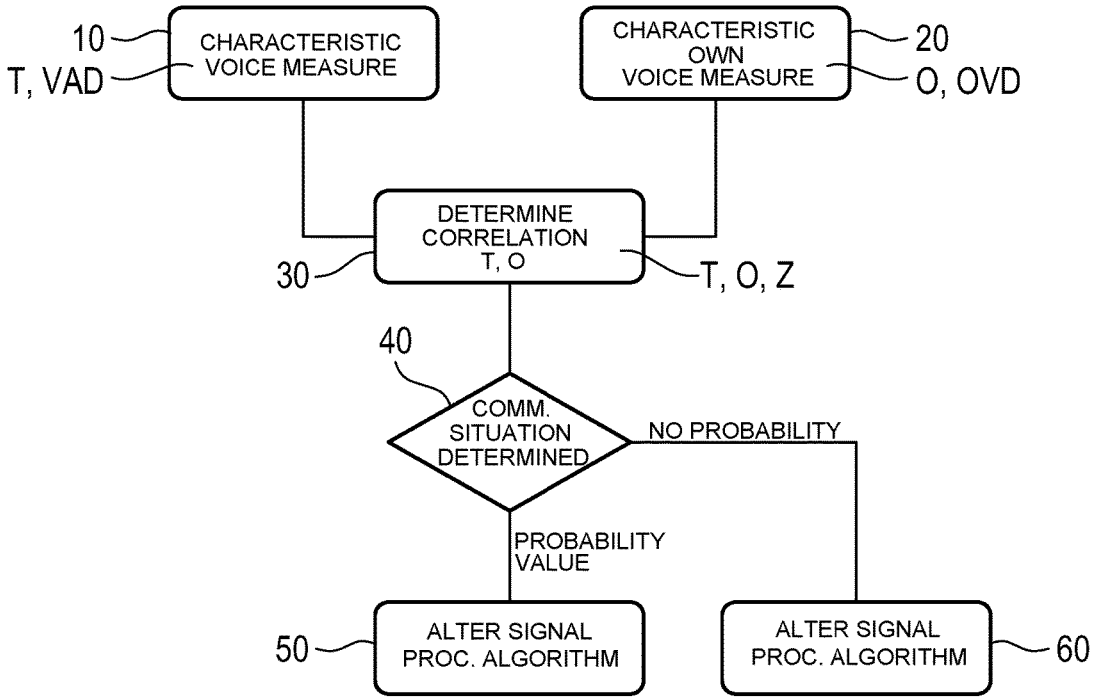
FIG. 2 shows a schematic flowchart for a sequence of a method of operation carried out by the hearing apparatus.

In order to be able to detect a communication situation, i.e. a situation in which the hearing device wearer converses with a third party (i.e. speaks with this third party), and then to adapt the signal processing, a method of operation, which is described in more detail below with reference to FIG. 2, is performed in the hearing device 1, specifically by the signal processor 4. In this case, the signal processor 4 comprises a voice activity detection module ("voice activity detector" or "VAD") for detecting voice components in the ambient sounds, and an own voice detection module ("own voice detector" or "OVD") for detecting the own voice of the hearing device wearer.

In a first method step 10, the voice activity detector VAD is used to determine a characteristic voice measure T for a voice component contained in the ambient sounds. The voice measure T in this case is a probability value that reflects a probability of the presence of the voice component. In a second method step 20, the own voice detector OVD is used to ascertain a characteristic own voice measure O for the presence of the own voice of the hearing device wearer (HIW for "hearing instrument wearer"). This own voice measure O, analogously to the voice measure T, is likewise a probability value. Furthermore, the own voice measure O is characteristic of an activity of the hearing device wearer, namely of he himself speaking.

In an alternative exemplary embodiment, the voice measure is a binary variable that can assume just two values or states. These two values are in this case representative of the presence or absence of the voice component in the ambient sound. By way of example, the voice measure T assumes the value "1" if a voice component is detected in the ambient sounds. Accordingly vice versa, the voice measure T assumes the value "0" if no voice component is detected in the ambient sounds. The same also applies mutatis mutandis to the own voice measure O.

Figure 3:
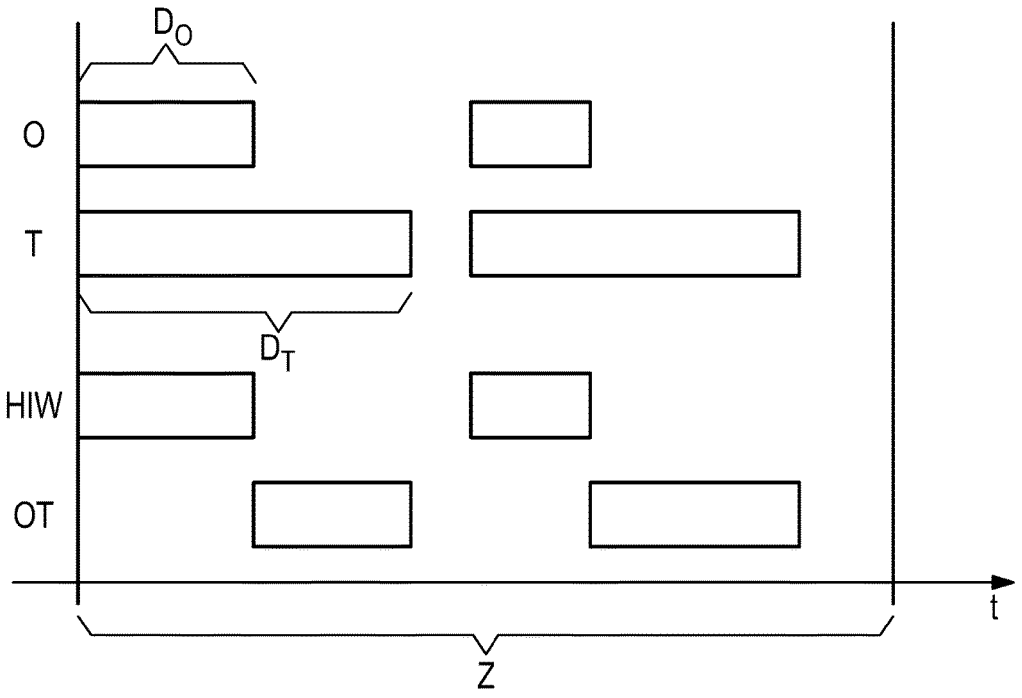
FIG. 3 shows a diagram of a schematic timing that results in detection of a communication situation when the method of operating shown in FIG. 2 is executed.

In a further method step 30, the voice measure T and the own voice measure O are combined. If at least the voice measure T has a (probability) value representative of the presence of the voice components, a correlation between the voice measure T and the own voice measure O is evaluated. This evaluation involves a temporal response of the voice measure T and of the own voice measure O being considered in this case. To detect a communication situation, i.e. to detect whether the hearing device wearer is speaking with a third party, the criterion checked in this case is whether within a period (referred to as "time window Z") the own voice measure O assumes the value representative of the presence of the own voice of the hearing device wearer. In this case, the further criterion checked is furthermore whether a length of time DO for which the own voice measure O assumes the value representative of the value of the own voice is different than a length of time DT for which the voice measure T assumes the value representative of the presence of the voice components, specifically whether the length of time DO is shorter than the length of time DT (cf. FIG. 3). The reason is that this situation indicates that both the own voice of the hearing device wearer—cf. diagram in FIG. 3, "HIW line"—and the voice of a third party—cf. diagram in FIG. 3, "OT ("other talker") line"—(specifically for respective different time periods) are present. This is because it has been found that the voice measure T indicates both the presence of voice components of the third party and the presence of the own voice of the hearing device wearer. The additional criterion checked is furthermore whether within the time window Z the own voice measure O or (optionally and) the voice measure T assume the value representative of the presence of the own voice and the voice component at least twice (cf. FIG. 3). This indicates a "dialog" between the hearing device wearer and the third party, such that there is a comparatively high probability of a conversation, i.e. The communication situation, being present. The further criterion checked is furthermore whether the length of time DO and the length for time for which only the voice measure T has the value representative of the presence of the voice component are longer than 2 seconds. An utterance of such length by the hearing device wearer and/or the third party likewise indicates a conversation between these people.

In a decision step 40, it is subsequently checked whether the aforementioned criteria are satisfied. For each satisfied criterion, a probability value for the presence of the communication situation is increased in this case. If the probability value exceeds a prescribed threshold value—i.e. if a sufficient probability of the presence of the communication situation is ascertained—then in a subsequent method step 50 the signal processing algorithm is altered on the basis of the current value of the probability. Specifically, at least one parameter of the signal processing algorithm directed at voice intelligibility is altered in this case, so that the voice reproduction of the hearing device 1 is improved. Alternatively, the threshold value comparison can also be dispensed with, the or the respective parameter being altered over the entire range of values of the probability value on the basis thereof.

As an alternative to method step 50, i.e. if no probability has been assigned for the presence of the communication situation, specifically the criteria described above are not satisfied, an alternative method step 60 involves the signal processing algorithm being altered not on the basis of the probability value for the communication situation, but rather possibly only on the basis of probability values for alternative hearing situations.

In an alternative exemplary embodiment (not depicted in more detail), instead of the own voice detector OVD a rotation sensor of the hearing device 1 is used, by means of which a supplementary measure characteristic of an activity, specifically a head rotation of the hearing device wearer, is ascertained. The voice measure T and the supplementary measure are evaluated for whether the hearing device wearer turns his head in the direction of the source of the voice components in the ambient sounds. This is interpreted to mean that the hearing device wearer looks at his interlocutor. The probability value is then increased to a value representative of the presence of the communication situation.

Figure 4:
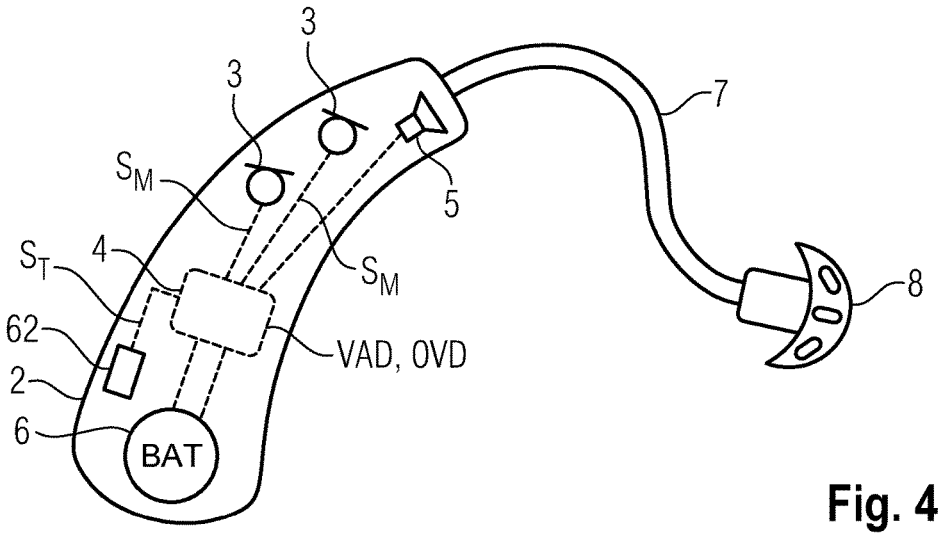
FIG. 4 shows a view according to FIG. 1 of the hearing device according to a further exemplary embodiment.

FIG. 4 depicts an alternative exemplary embodiment of the hearing device 1. This hearing device 1 has an input interface 62 that is set up to receive an audio signal ST provided by an external source and transmitted as a data signal. On reception, the audio signal ST is forwarded to the signal processor 4 and used by the latter—in response to user activation of a hearing situation referred to as a "listening situation"—to produce the output signal SA. Specifically, the microphone signal SM is almost suppressed in this case so that the output signal SA preferably contains only the audio signal ST. In such a listening situation, during the reproduction of the audio signal ST in the form of the output signal SA in method step 50 (that is to say when the communication situation is detected), the microphone signal SM is mixed with the audio signal ST in the output signal SA in boosted fashion, so that the perceptibility and intelligibility of the microphone signal SM are increased. Also, the audio signal SA is withdrawn in this case. This means that there is no need for active alteration of the signal processing algorithm of the hearing device 1 by the hearing device wearer ("changeover" to an appropriate conversation program).

In a further exemplary embodiment (not depicted in more detail), there is a change back to the signal processing settings of the listening situation (and hence to the prioritized reproduction of the external audio signal SA) again if the probability value for the presence of the communication situation has been decreased such that there is no communication situation present, and is still decreased even after a prescribed length of time, for example 10 seconds.

The subject matter of the invention is not restricted to the exemplary embodiments described above. Rather, further embodiments of the invention can be derived from the description above by a person skilled in the art. In particular, the individual features of the invention that are described with reference to the various exemplary embodiments, and the configuration variants of said invention, can also be combined with one another in a different way.

The following is a summary list of reference numerals and the corresponding structure used in the above description of the invention:

1 Hearing device
2 Housing
3 Microphone
4 Signal processor
5 Loudspeaker
6 Battery
7 Sound tube
8 Earpiece
10 Method step
20 Method step
30 Method step
40 Decision step
50 Method step
60 Method step
62 Input interface
DO Length of time
DT Length of time
O Own voice measure
OVD Own voice detector
SA Output signal
SM Microphone signal
ST Audio signal
T Voice measure
VAD Voice activity detector
Z Time window

The invention claimed is:

1. A method for operating a hearing apparatus, the hearing apparatus having a microphone for converting ambient sound into a microphone signal, a signal processor for processing the microphone signal into an output signal and an output transducer for outputting the output signal to the ear of a wearer of the hearing apparatus, the method comprising:

ascertaining a characteristic voice measure for a voice component contained in the ambient sounds;

ascertaining a characteristic supplementary measure of an activity of the wearer of the hearing apparatus;

evaluating a correlation between the voice measure and the supplementary measure;

using a result of the evaluating step to increase a probability value for a presence of a communication situation between the wearer of the hearing apparatus and a third party, if the voice measure and the supplementary measure, under at least one prescribed criterion, assume a value that is representative of a presence of the voice component and of the activity of the wearer;

wherein the at least one prescribed criterion is a temporal correlation between the voice measure and the supplementary measure; and using the probability value for the presence of the communication situation as a basis for altering a signal processing algorithm that is executed to process the microphone signal.

2. The method according to claim 1, wherein the supplementary measure is an own voice measure characteristic of a presence of the own voice of a wearer of the hearing apparatus, and wherein the probability value for the presence of the communication situation is determined by evaluating a correlation between the voice measure and the own measure.

3. The method according to claim 2, which comprises precluding the presence of the communication situation if the voice measure and the own voice measure substantially concurrently assume the value representative of the presence of the voice component and of the own voice of the wearer.

4. The method according to claim 2, which comprises increasing the probability value for the presence of the communication situation if a temporal difference between the voice measure and the own measure is ascertained.

5. The method according to claim 4, which comprises increasing the probability value for the presence of the communication situation if within a prescribed period the voice measure and the own voice measure assume a value that is representative of the voice component or of the own voice of the wearer for a respective different length of time.

6. The method according to claim 5, which comprises ignoring phases in which the voice measure does not assume a value that is representative of the presence of the voice component within the prescribed period.

7. The method according to claim 5, wherein the prescribed criterion used is that within the prescribed period the voice measure and/or the own voice measure repeatedly assume the value representative of the presence of the voice component or of the own voice of the wearer.

8. The method according to claim 5, wherein the criterion used is that within the prescribed period the length of time for which the voice measure assumes the value representative of the presence of the voice component approaches twice the length of time for which the own voice measure assumes the value representative of the presence of the own voice of the wearer.

9. The method according to claim 1, wherein the hearing apparatus comprises a classifier for detecting different hearing situations, and the method comprises altering the signal processing algorithm with a higher priority in comparison with other hearing situations detected in parallel on a basis of the probability value for the presence of the communication situation.

10. The method according to claim 1, which comprises using a criterion that within a past period of time of prescribed length the probability value for the presence of the communication situation has had a prescribed value.

11. The method according to claim 1, which comprises taking into consideration a wearer-specific inclination toward verbal communication.

12. The method according to claim 1, which comprises precluding the presence of the communication situation if only the voice measure assumes the value representative of the presence of the voice component.

13. The method according to claim 1, which comprises using a memory unit of the hearing apparatus to store a frequency index for an alteration of the signal processing algorithm on the basis of the probability value for the presence of the communication situation.

14. The method according to claim 1, which comprises, during a reproduction of an external audio signal, producing the output signal by altering a mix ratio between the microphone signal and the audio signal on a basis of the probability value for the presence of the communication situation.

15. The method according to claim 14, which comprises, when the probability value for the presence of the communication situation has been increased, producing the output signal by increasing a proportion of the microphone signal relative to the audio signal.

16. The method according to claim 1, which comprises, when the probability value for the presence of the communication situation is decreased, resetting the alteration of the signal processing algorithm.

17. The method according to claim 16, which comprises resetting the alteration of the signal processing algorithm after an additional expiry of a prescribed waiting time, and thereby resetting an altered mix ratio between the microphone signal and the audio signal.

18. A hearing apparatus, comprising:

a microphone for converting ambient sounds into a microphone signal;

a signal processor for processing the microphone signal by way of a signal processing algorithm to generate an output signal, said signal processor being configured to perform the method according to claim 1; and an output transducer for outputting the output signal to the ear of a wearer of the hearing apparatus.

19. The hearing apparatus according to claim 18, which comprises an input interface configured for receiving an external audio signal.

* * * * *